United States Patent [19]

Leismer

[11] Patent Number: 4,976,317

[45] Date of Patent: Dec. 11, 1990

[54] WELL TOOL HYDROSTATIC RELEASE MEANS

[75] Inventor: Dwayne D. Leismer, Pearland, Tex.

[73] Assignee: Camco International Inc., Houston, Tex.

[21] Appl. No.: 387,206

[22] Filed: Jul. 31, 1989

[51] Int. Cl.[5] ..... E21B 34/10; E21B 43/12

[52] U.S. Cl. ..... 166/321; 166/324; 166/375

[58] Field of Search ..... 166/324, 321, 325, 327, 166/332, 375, 374

[56] References Cited

U.S. PATENT DOCUMENTS

| | | | |
|---|---|---|---|
| Re. 32,390 | 4/1987 | Pringle | 166/321 |
| 2,909,227 | 10/1959 | Bostock | 166/325 |
| 4,161,219 | 7/1979 | Pringle | 166/324 |
| 4,373,587 | 2/1983 | Pringle | 166/324 |
| 4,376,464 | 3/1983 | Crow | 166/324 |
| 4,569,398 | 2/1986 | Pringle | 166/321 |
| 4,629,002 | 12/1986 | Pringle | 166/324 |
| 4,660,646 | 4/1987 | Blizzard | 166/321 |
| 4,722,399 | 2/1988 | Pringle | 166/324 |
| 4,791,990 | 12/1988 | Amani | 166/324 X |

*Primary Examiner*—Stephen J. Novosad
*Attorney, Agent, or Firm*—Fulbright & Jaworski

[57] ABSTRACT

A release mechanism for use in a well tool that requires a hydraulic piston area to be equalized with a minimum force. A valve seat and valve element are positioned in a fluid passageway for actuating the assembly. A rod having a first and second section is connected to the assembly and movable for moving the second section into the valve seat. The second section has a smaller cross-sectional area and smaller length than the first section. The area of the valve seat is less than the cross-sectional area of first section but larger than the second section. The release mechanism allows the sealing area to be reduced without reducing the strength of the rod.

6 Claims, 4 Drawing Sheets

FIG.1E
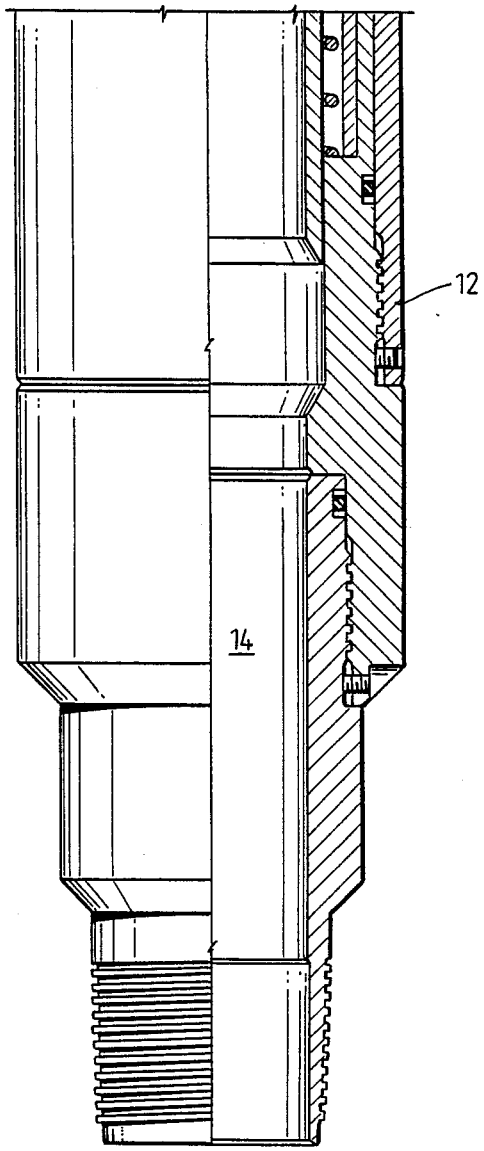
FIG.2
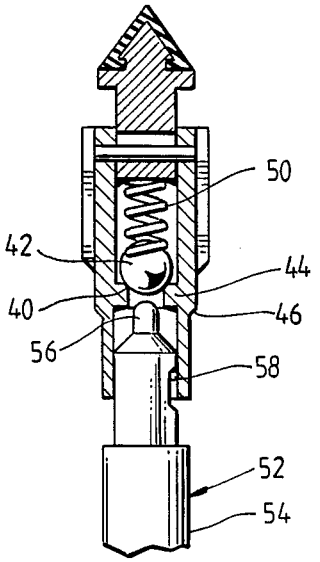
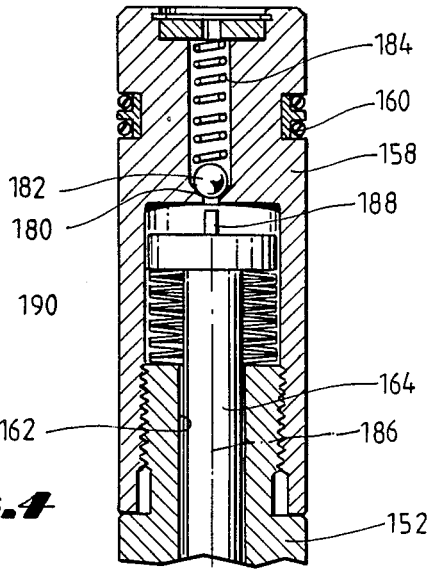
FIG.4

WELL TOOL HYDROSTATIC RELEASE MEANS

BACKGROUND OF THE INVENTION

The present invention is directed to hydrostatic release mechanism for use in a well tool having a hydraulic piston and cylinder assembly which is required to be equalized.

The problem the present invention overcomes is that actuating piston and cylinder assemblies used in well tools, such as safety valves, require a seal which equalizes pressure between the hydrostatic operating pressure and the well pressure when the valves are closed, due to fail safe requirements. For example, see U. S. Pat. Nos. 4,161,219; 4,569,398; RE. 32,390; and 4,660,646; which illustrate various types of seals and sealing valves which provide relatively small areas for limiting the force caused by the hydrostatic pressure thereby allowing the well tools to be used at greater depths. Small seals or sealing valves require small piston mechanism components which are susceptible to damage. That is, the small piston rods, which were subject to the full actuating loads of the piston and cylinder assemblies, are subject to failure. Because of the relatively high loads involved to actuate the sealing area, the seal area components have to thereby be large, consequently increasing the piston rod area, thereby limiting the hydrostatic pressure that it could equalize against, and thereby further limiting the depth at which the safety valve could be used.

The present hydrostatic release means isolates the piston and cylinder assembly loads from the sealing area. The present invention allows the sealing area to be vastly reduced from the prior art designs without further reducing the size of the load carrying component. This allows the sealing area to equalize against greater hydrostatic head pressures and thus allows the well tool to be set at a greater depth.

SUMMARY

The present invention is directed to a well tool having a housing with a hydraulic piston and cylinder assembly therein for actuating the tool. The housing includes a fluid passageway in communication with the piston and cylinder assembly and is adapted to be in communication with control fluid at the well surface. The present invention is directed to an improvement in means equalizing hydrostatic pressure acting on the assembly and includes a valve seat and a valve element positioned in the fluid passageway for closing the passageway when the assembly is actuated by control fluid. A rod having first and second sections is connected to the assembly and is movable by the assembly for moving the second section into the valve seat. The second section has a smaller cross-sectional area and a smaller length than the cross-sectional area and length of the first section. The area through the valve seat is less than the cross-sectional area of the first section, but is larger than the cross-sectional area of the second section. This mechanism allows the use of a small sealing valve seat and valve element but a larger rod to withstand the full actuating loads of the piston and cylinder assembly.

Still a further object is wherein the valve seat and valve element are carried by a support member which is movably positioned in the passageway. The passageway includes a seat and the support includes means for seating in the passageway seat. The passageway seat has a greater cross-sectional area than the cross-sectional area of the first section whereby the first section may move through the passageway seat.

Still a further object of the present invention is wherein the rod first section is a cylindrical solid section and the second section is a solid section extending from the center longitudinal axis of the first section.

Still a further object of the present invention is the provision of a subsurface well safety valve for controlling the fluid flow through a well conduit and including a housing having a bore and a valve closure member moving between open and close positions for controlling the fluid flow through the bore. A flow tube telescopically moves in the housing for controlling the movement of the valve closure member and a hydraulic piston and cylinder assembly in the housing engages and moves the flow tube. The housing includes a hydraulic control passageway in communication with the assembly and is adapted to be in communication with control fluid at the well surface. Biasing means move the flow tube in a direction to close the valve. The hydrostatic release mechanism equalizes hydrostatic pressure acting upon the piston and cylinder assembly by the use of a valve seat and valve element in the fluid passageway and a rod having first and second sections of differing cross-sectional areas and lengths connected to and actuated by the assembly. This allows the sealing area of the valve and valve seat to be reduced while still allowing the rod to be sized to carry the required loading.

Other and further objects, features, and advantages will be apparent from the following description of presently preferred embodiments of the invention, given for the purpose of disclosure and taken in conjunction with the accompanying drawings.

BRIEF DESCRIPTION OF THE DRAWINGS

FIGS. 1A, 1B, 1C, 1D, and 1E are continuations of each other of one type of well safety valve, shown in elevational view, in quarter section, utilizing the present invention, FIG. 2 is an enlarged elevational view partly in cross section, illustrating the hydrostatic release means shown in FIG. 1B, FIGS. 3A, 3B, 3C, and 3D are continuations of each other and are elevational views, in cross section, of another type of well safety valve utilizing another embodiment of the hydrostatic release means of the present invention, and FIG. 4 is an enlarged elevational cross-sectional view of the hydrostatic release means of FIG. 3B.

DESCRIPTION OF THE PREFERRED EMBODIMENT

Figure 1A:
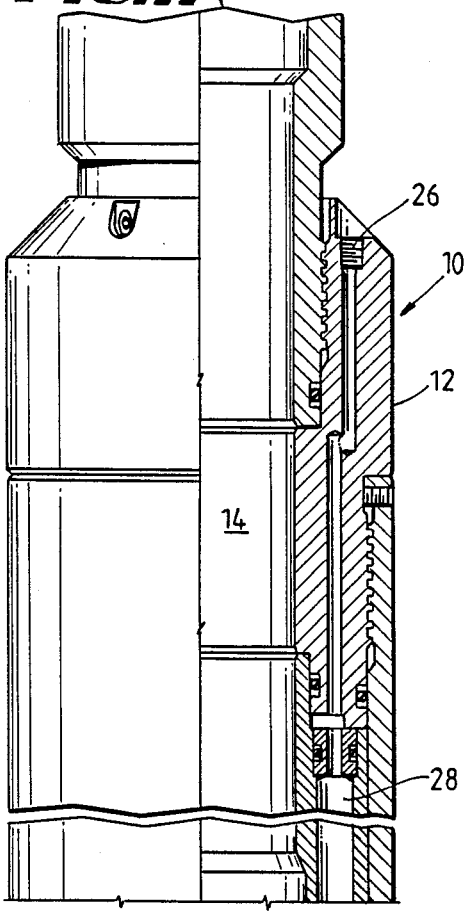
Figure 1C:
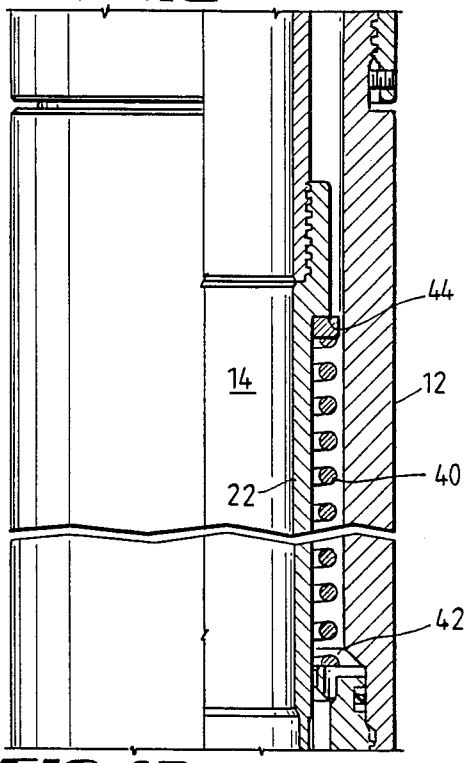

While the hydrostatic release means of the present invention may be utilized in various types of well tools, such as chemical injection valves, circulating kill valves, or any well tool that requires a hydraulic piston and cylinder area to be equalized with a minimum of force, the present invention is particularly useful in subsurface well safety valves and for purposes of illustration only, will be shown as incorporated into two different types of safety valves.

Referring now to the drawings, and particularly to FIGS. 1A–1E, the use of the present invention in a subsurface safety valve generally similar to that shown in U.S. Pat. No. 4,569,398, is best seen. The safety valve is generally indicated by the reference numeral 10 and includes a body or housing 12 adapted to be connected in a well tubing to form a part thereof and permit well production therethrough under normal operating conditions, but in which the safety valve 10 may close or be closed as desired.

The safety valve 10 includes a bore 14, a valve closure member or flapper valve 18 (FIG. 1D) connected to the body 12 by a pivot pin 20. A tubular member or flow tube 22 is telescopically movable in the body 12 and through the valve seats 16.

Figure 1B:
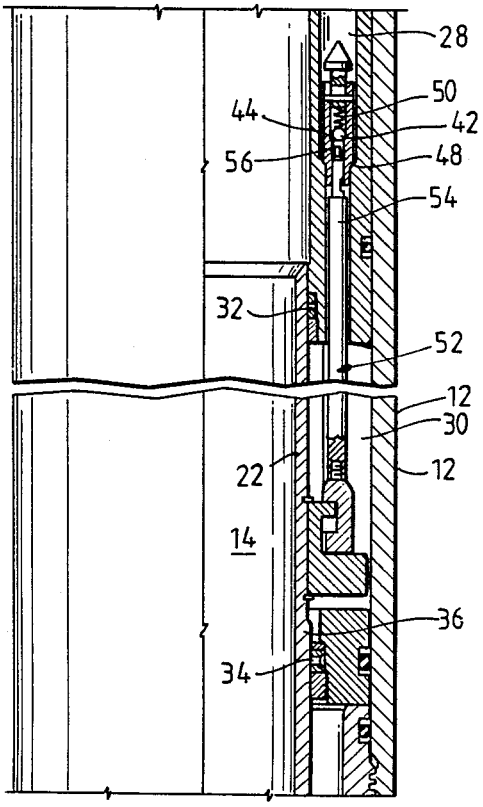
Figure 1D:
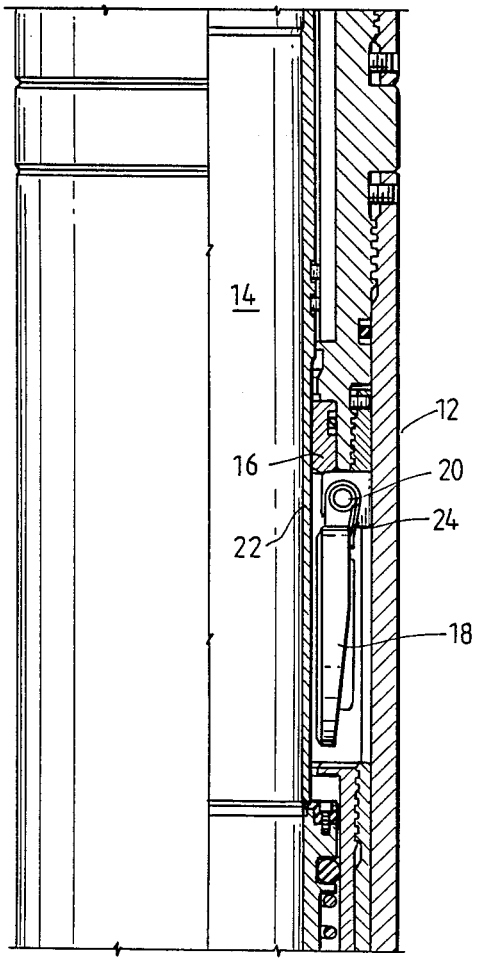

As best seen in FIG. 1D, when the flow tube 22 is moved to a downward position, the tube 22 pushes the flapper 18 away from the valve seat 16. Thus the valve 10 is held in the open position so long as the flow tube 22 is in the downward position. When the flow tube 22 is moved upwardly, the flapper 18 is allowed to move upwardly onto the seat 16 by the action of a spring 24 and block flow upwardly through the bore 14.

The safety valve 10 is controlled by the application or removal of pressurized hydraulic fluid through a control path or line (not shown) extending to the well surface which supplies a pressurized fluid to a port 26, and then to a fluid passageway 28, and to a piston and cylinder assembly which includes a fluid chamber 30 which is formed by spaced seals 32 and 34 of different diameters. The assembly includes a piston 36 which is movable in the fluid chamber 30, one of which, here the piston, is connected to the flow tube 22. When hydraulic fluid is applied to the port 26, the passageway 28 and into the fluid chamber 30, the piston 36 and flow tube 22 will be moved downwardly forcing the valve closure member 18 off the seat 16 and into the full open position. When the hydraulic fluid is released from the port 26 and is reduced sufficiently, various biasing means will urge the tube 22 upwardly beyond the seat 16 allowing the flapper 18 to swing and close the seat 16. The biasing means may include a spring 40 (FIG. 1C) acting between a shoulder 42 on the housing 12 and shoulder 44 on the flow tube 22. The biasing means may also include pressurized fluid such as the pressure of the fluid in the bore 14 acting on the bottom of the piston 36.

The seals 32 and 34 may be of any suitable type of minimum leaking seals that offers resistance to fluid flow so that the piston 36 may be actuated from the well surface, but are designed to provide leaking into and from the chamber 30. Preferably, as shown, the seals 32 and 34 are metal seals.

However, in order to provide means for limiting the amount of leakage from the chamber 30 of the hydraulic control fluid supplied through the port 26, the prior art, as shown in U.S. Pat. No. 4,569,398, provided a valve seat and valve element in the fluid passageway 28 above the chamber 30 to close the passageway 28 when the safety valve 10 was in the open position. In addition, a rod connected to the piston and cylinder assembly was used to move through the valve seat carrying the ball upwardly when the safety valve 10 was moved to the closed position. The biasing forces of the spring and well fluids were required to overcome the hydrostatic force on top of the ball element. Therefore, while the safety valve could be used at greater depths by minimizing the size of the ball and valve seat, this also reduce the size of the rod which moved the ball off of the seat. However, reducing the size of the rod reduces its strength and therefore the size of the rod became a limiting factor in reducing the effect of hydrostatic head and the depth that the safety valve could be set.

The above description of the safety valve is generally disclosed in U.S. Pat. No. 4,569,398. The present invention is directed to an improved hydrostatic release means which allows the sealing area to be made small to limit the force caused by the hydrostatic pressure from the well surface but allows the actuating rod which releases the hydrostatic pressure to be of a sufficient size to withstand the forces involved.

Referring now to FIGS. 1B and 2, a sealing means for sealing off the fluid passageway 28 from the chamber 30 when the safety valve 10 is in the open position is shown as a valve seat 40 and a valve element such as a ball 42 which are positioned in the fluid passageway 28 for closing the passageway 28 from the fluid chamber 30 when the piston and cylinder assembly is actuated by control fluid injected from the well surface to the fluid passageway 28. Preferably, the valve seat 40 and the valve element 42 are carried by a support member 44 which is movably positioned in the passageway 28. The support 44 includes a sealing shoulder 46 for sealing on a passageway seat 48. A spring 50 may be provided for urging the ball 42 onto the seat 40.

A rod generally indicated by the reference numeral 52 which is connected to the piston and cylinder assembly such as to the piston 36 and is movable by the assembly. As hydraulic fluid is applied from the well surface to the passageway 28, the piston 36 and the rod 52 move downwardly and the valve 10 is opened. When the support 44 seats on the passageway seat 48 and the ball 42 is seated on the valve seat 40, hydraulic control fluid from the well surface is prevented from leaking into the fluid chamber 30.

The rod 52 includes a first section 54 and a second section 56. It is to be noted that the second section 56 has a smaller cross-sectional area and a smaller length than the cross-sectional area and length of the first section 54. It is also to be noted that the area through the valve seat 40 is less than the cross-sectional area of the first section 54 of the rod 52, but is larger than the cross-sectional area of the second section 56 of the rod 52.

The structure of the hydrostatic release means described allows the cross-sectional area of the valve seat 40 and ball 42 to be made small in order to reduce the hydrostatic force acting on the top of the ball 42 from the fluid passageway 28. However, the length and cross-sectional area of the first section 54 of the rod is sufficiently large to withstand the closing forces involved. That is, only the smaller length and smaller cross-sectional section 56 of the rod 54 moves through the valve seat 40 as the safety valve 10 is closed. Upward movement of the second section 56 through the valve seat 40 moves the ball 42 upwardly against the hydrostatic pressure and releases the hydrostatic pressure. While the cross-sectional area of the second section 56 may be small, it can withstand the loading exerted on the rod 52 by virtue of its short length. After the ball 42 is unseated from the valve seat 40 and the hydrostatic pressure in the fluid passageway 28 is released, further upward movement of the rod 52 will carry the support 44 upwardly in the passageway 28. The cross-sectional area of the passageway seat 48 in the passageway 28 has a greater cross-sectional area therethrough than the cross-sectional area of the first section 54 of the rod 52. Therefore, the enlarged section 54 may move upwardly through the seat 48 as the valve 10 moves to the closed position. However, it is to be noted that by virtue of the above recited structure that the enlarged section 54 of the rod 52 does not have to move the entire member 44 upwardly against hydrostatic pressure as the pressure has been relieved by the movement of the ball valve element 42 off of the seat 40.

Thus, in operation, when it is desired to open the safety valve 10, hydraulic pressure from the well surface is applied to the port 26, through the passageway 28, and to the chamber 20, to move the piston 36 downwardly. This carries the flow tube 22 through the seat 16 and opens the flapper 18. Downward movement of the piston 36 also moves the rod 52 downwardly along with the support 44 by engaging a shoulder 58 on the support 44. When the flapper 18 is open, the support 44 seats on the passageway seat 48 and seals with the sealing surface 46. Also, the ball 42 seats on the valve seat 40 and prevents loss of hydraulic control fluid while the safety valve 10 is open.

When it is desired to close the safety valve 10, pressure is relieved from the port 26, passageway 28, and the chamber 30, and the biasing means including the spring 40 and well pressure acting on the piston 36 moves the rod 52 upwardly. Movement of the second section 56 through the valve seat 40 raises the ball 42 off the seat 40 against the hydrostatic pressure in the fluid passageway 28 to balance the hydrostatic pressure across the support 44. Continued upward movement of the rod 52 along with the piston 36 and flow tube 22 causes the rod 52 to raise the support 44 and allows the first section 54 of the rod 52 to move through the passageway seat 48.

Referring now to FIGS. 3A–3D and 4, the use of the present hydrostatic release means in a well safety valve similar to that described in U.S. Pat. No. 4,660,646, is seen. The subsurface safety valve is generally indicated by the reference numeral 110 and generally includes a body or housing 116 adapted to be connected in a well tubing.

Figure 3A:
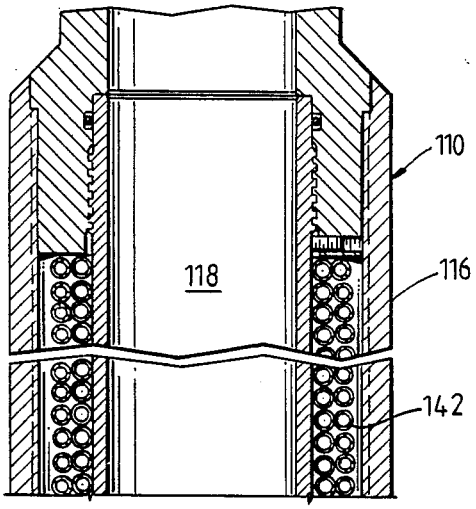
Figure 3B:
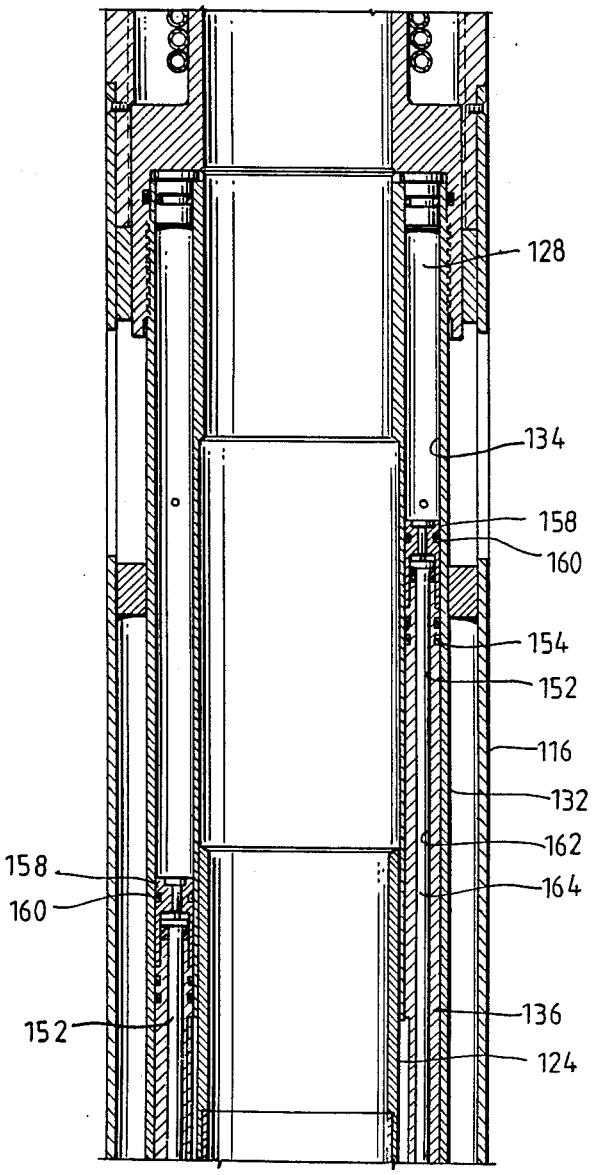
Figure 3C:
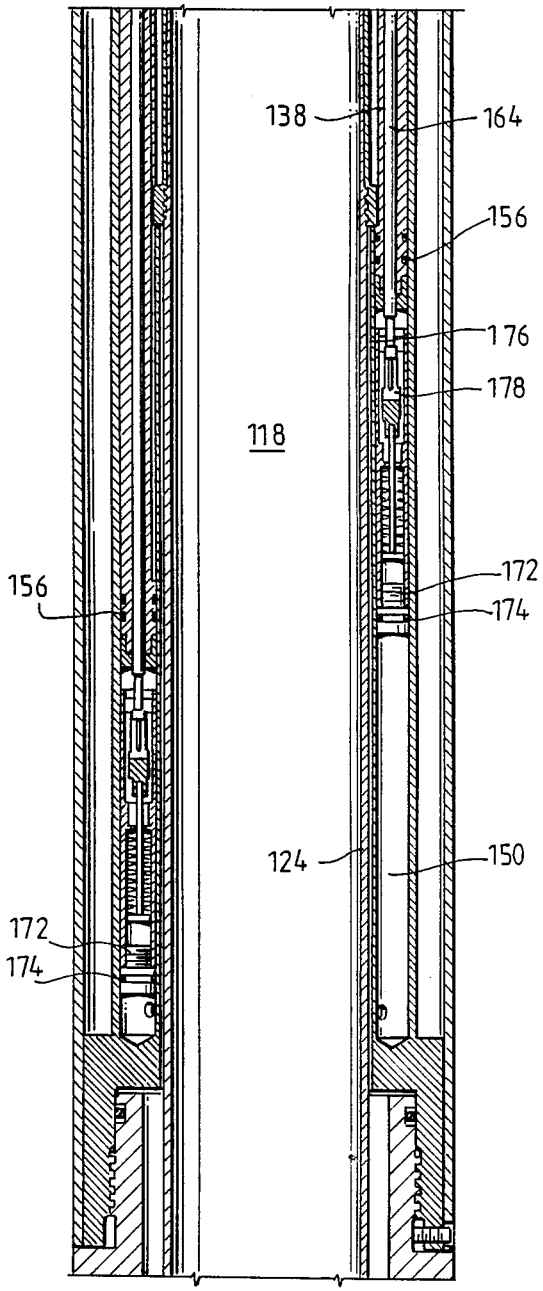
Figure 3D:
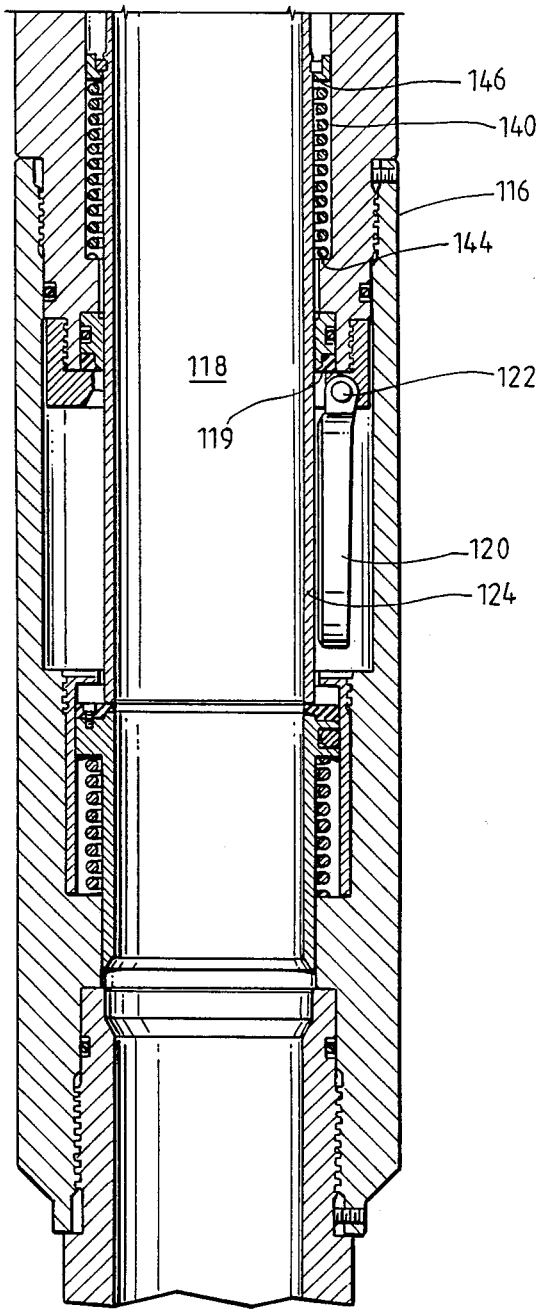

The valve 110 includes a bore 118, and as best seen in FIG. 3D, includes an annular valve seat 119, a valve closure element or flapper valve 120 connected to the body 116 by a pivot pin 122. When the valve closure member 120 is in the upper position and seated on the valve seat 119, the safety valve 110 is closed blocking flow upwardly through the bore 118 and the well tubing.

A tubular member flow tube 124 is telescopically movable in the body 116 and through the valve seat 119. When the flow tube 124 is moved to a downward position, the flow tube 124 pushes the flapper 120 away from the valve seat 119. Thus the valve 110 is held in the open position so long as the flow tube 124 is in the downward position.

The safety valve 110 is controlled by the application or removal of a pressurized fluid, such as hydraulic fluid, through a control path or line (not shown) which extends to the well surface to supply pressurized hydraulic fluid to the top of a piston and cylinder assembly generally indicated by the reference numeral 132 (FIG. 3B) and which generally includes a cylinder generally indicated by the reference numeral 134 and a piston system generally indicated by the reference numeral 136. One of the piston 136 and cylinder 134 is connected to the flow tube 124, such as the piston 136, by a connection 138. Therefore, the application is a pressurized hydraulic fluid to the top or first side of the piston 132 will move the flow tube 124 downwardly forcing the flapper valve 120 off of the seat 119. Biasing means, such as a spring 140 (FIG. 3D) and a pressurized gas chamber 142, which may include a plurality of tubing coils containing pressurized nitrogen, is provided for yieldably urging the flow tube 124 upwardly in a direction to release the flapper valve element 120 for closing the valve 110. Spring 140 acts between a shoulder 144 on the housing 116 and a shoulder 146 on the flow tube 124. The pressurized gas chamber 142 is connected to compartment 150 by a line (not shown) and is in communication with the second side of the piston and cylinder assembly 132 and acts on the assembly 132 in a direction to close the valve 110. The pressurized gas in the compartment 150 is the primary and main force for moving the valve 110 to a close position.

Referring now to FIGS. 3B and 3C, the piston system 136 includes a first piston 152 having a first seal 154 and a second seal 156 operable in the cylinder 134. The first piston 152 between the spaced seals 154 and 156 is exposed to pressure in the bore 118 as the fluid pressure in the bore 118 may be in communication with the piston 152 between the unsealed engagement of the flow tube 124 with the inside of the housing 116. This insures that the piston and cylinder assembly 132 is pressure balanced as to the fluid pressure in the bore 118.

A second piston 158 having a seal 160 is movable in the cylinder 134. The first piston 152 and the second piston 158 include an equalizing passageway 162 through which a piston rod 164 extends. The piston rod 164 is not sealed in the passageway 162 and consequently fluid flow may flow through the passageway 162 in spite of the presence of the piston rod 164.

Referring now to FIG. 3C, a third piston 172 having a piston seal 174 is positioned at the second end of the first piston 152 and is connected to the piston rod 164 by a spring loaded releasable connection. The releasable connection may be a spring collet 176 connected to the rod 162 and positioned in a tapering cavity 178 in the piston 172. It is to be noted that the collet 176 and cavity 178 allows movement between the piston 172 and the rod 164 in the cylinder 134 upon contraction of the collet 176.

The above general structure is disclosed in U.S. Pat. No. 4,660,646. The hydraulic release means of the present invention may be incorporated in that structure and is best seen in FIGS. 3B and 4. Thus, a valve seat 180 is provided in the second piston 158 and a valve element 182 is adapted to seat thereon and is urged into a seating relationship by spring means 184. The piston rod 164 includes a first section 186 and a second section 188. The second section 188 has a smaller cross-sectional area and a smaller length than the cross-sectional area and length of the first section 186. It is also noted that the area through the valve seat 180 is less than the cross-sectional area of the first section 186, but is larger than the cross-sectional area of the second section 188. A spring 190 acting between the piston rod 186 and the first piston 152 acts in a direction to move the second section 188 into the valve seat 182 and unseat the valve element 180.

Generally, the safety valve 110 opens as hydraulic pressure above a specified value is applied to the passageway 128 leading from the well surface to the piston system 136 moving the piston system 136 in the cylinder 134. The first piston 152 which is connected to the flow tube 124 moves the flow tube 124 downwardly to open the flapper valve element 120 to place the safety valve 110 in the open position. To close the valve 110, hydraulic pressure in the passageway 128 is decreased below the pressure of the compressed gas in the chamber 142 and compartment 150 which acts on the piston system 136 to move the piston system 136 upwardly, retracting the flow tube 124 and allowing the flapper 120 to close.

In this normal operation, the hydrostatic release mechanism of FIG. 4 is not needed. (However, initially the ball 180 is unseated due to the action of section 188, and fluid will flow down the passageway 162 through the first piston 152 and act on the third piston 178 which moves downwardly pulling the piston rod 164 downwardly to remove the second section 188 and allow the ball 180 to seat on the seat 182 and close the passageway 162. Thereafter, additional hydraulic operating pressure acts only across the second piston 158 to drive the piston system 136 downwardly to open the valve.)

There are various ways that the fail-safe closure of the safety valve 110 could occur even in the event of a failure:

Event 1—in which gas leaks out of compartment 150.

If seal 174 on piston 172 fails or otherwise gas leaks out of the compartment 150, the gas in the compartment will be reduced to the level of the pressure being applied on the top of the piston assembly 136. Thereafter, by reducing the hydraulic pressure in the passageway 128, the pressure above the piston system 136 is reduced until it equals the now-reduced gas pressure in the compartment 150. This will allow the spring 190 to move the piston rod 164 upwardly moving the second section 188 through the valve seat 182 unseating the ball valve 180 thereby allowing the hydrostatic fluid in the cylinder 134 to move through the equalizing passageway 162 and be applied against the bottom end of the first piston 152 and the second piston 158 thereby placing the entire piston system 136 in equilibrium. With this existing equilibrium, the spring 140 may now lift the flow tube 124 and Piston assembly 136 upwardly through the hydraulic fluid in the cylinder 134 thereby closing the safety valve 110.

Event 1—failure of seal 160 on second piston 158.

In this case hydraulic fluid flow would bypass seal 160 move between the first piston 152 and the second piston 158 and into the equilizing passageway 162 to move therethrough and act on the third piston 172. Thus, the hydraulic pressure on the first piston 152 and second piston 158 is in equilibrium and the gas pressure in the chamber 150 will close the valve 110.

Event 2 in which the seal 154, seal 156 on the first piston 152 fails.

A. First, assuming that the pressure in the gas compartment 150 is greater than the fluid pressure in the bore 118, the valve 110 will close as normal upon the decrease in the hydraulic fluid pressure in the passageway 128.

B. However, if the pressure charge in the chamber 150 is less than the pressure of the fluid in the bore 118, the bore pressure will enter the passageway 162 around the leaking seal and act on the lower or third piston 172. This acts to separate the third piston 172 from the first piston 152 and release the connection 176 and 178 thereby allowing the spring 190 to move the piston rod element 164 upwardly and move the ball 180 off of the seat 182 and open the passageway 162 to hydraulic fluid in the cylinder 134. This again equalizes the fluid pressure across the first 152 and second piston 158 and the third piston 172 has been disconnected thereby again allowing the spring 140 to lift the flow tube 24 and close the valve.

Of course, the hydrostatic release mechanism of the present invention may be used in other types of well safety valves such as disclosed in U.S. Pat. Nos. 4,161,219 and Re. 32,390, and other types of well tools which require hydraulic piston area to be equalized with minimum force. Such a mechanism may be used in chemical injection valves, annulus safety valves, and circulating kill valves.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. In a well tool having a housing with hydraulic piston and cylinder assembly therein for actuating said tool, said housing including a fluid passageway in communication with the piston and cylinder assembly and adapted to be in communication with control fluid at the well surface, the improvement in means equalizing hydrostatic pressure acting on the assembly comprising, a valve seat and valve element positioned in the fluid passageway for closing the passageway when the assembly is actuated by control fluid, a rod having first and second sections, said rod connected to the assembly and movable by the assembly for moving the second section into the valve seat, said second section having a smaller cross-sectional area and smaller length than the cross-sectional area and length of the first section, and the area through the valve seat being less than the cross-sectional area of the first section but larger than the cross-sectional area of the second section.

2. The apparatus of claim 1 wherein the valve seat and valve element are carried by a support member movably position in the passageway, said passageway having a seat and the support including means for sealing in the passageway seat, said passageway seat having a greater cross-sectional area than the cross-sectional area of the first section whereby the first section may move through the passageway seat.

3. The apparatus of claim 1 wherein the rod first section is a cylindrical solid section and the second section is a solid section extending from the center longitudinal axis of the first section.

4. In a subsurface well safety valve for controlling the fluid flow through a well conduit and including a housing having a bore and a valve closure member moving between open and closed positions for controlling the fluid flow through the bore, a flow tube telescopically moving in the housing for controlling the movement of the valve closure member, a hydraulic piston and cylinder assembly in the housing engaging and moving the flow tube, said housing having a hydraulic control passageway in communication with the assembly and adapted to be in communication with control fluid at the well surface and biasing means for moving the flow tube in a direction to close the valve, the improvement in means equalizing hydrostatic pressure acting on the assembly comprising, a valve seat and valve element positioned in the fluid passageway for closing the passageway when the assembly is actuated by control fluid, a rod having first and second sections, said rod connected to the assembly and movable by the assembly for moving the second section into the valve seat and moving the valve element, said second section having a smaller cross-sectional area and smaller length than the cross-sectional area and length of the first section, and the area through the valve seat being less than the cross-sectional area of the first section but larger than the cross-sectional area of the second section.

5. The apparatus of claim 4 wherein the valve seat and valve element are carried by a support member movably position in the passageway, said passageway having a seat and the support including means for sealing in the passageway seat, said passageway seat having a greater cross-sectional area than the cross-sectional area of the first section whereby the first section may move through the passageway seat.

6. The apparatus of claim 4 wherein the rod first section is a cylindrical solid section and the second section is a solid section extending from the center longitudinal axis of the first section.

* * * * *